US005348412A

United States Patent [19]

Fuller

[11] Patent Number: 5,348,412

[45] Date of Patent: Sep. 20, 1994

[54] RELEASABLE ATTACHMENT FOR A RING METAL TO A RING BINDER

[75] Inventor: Luke Fuller, Acushnet, Mass.

[73] Assignee: U.S. Ring Binder, New Bedford, Mass.

[21] Appl. No.: 953,511

[22] Filed: Sep. 29, 1992

[51] Int. Cl.[5] ..... B42F 13/00

[52] U.S. Cl. ..... 402/75; 402/29; 402/31; 402/37; 402/38

[58] Field of Search ..... 402/75, 29, 31, 35, 402/37, 38, 39

[56] References Cited

U.S. PATENT DOCUMENTS

| | | | |
|---|---|---|---|
| 968,657 | 8/1910 | Hamacher et al. | 402/37 |
| 1,291,320 | 1/1919 | Whitlock | 402/75 |
| 1,369,131 | 2/1921 | Schade | 402/75 |
| 1,399,629 | 12/1921 | Lewis | 402/75 |
| 1,466,313 | 8/1923 | Schade | 402/75 |
| 1,675,301 | 6/1928 | Dawson | 402/37 |
| 1,745,461 | 2/1930 | Trussell | 402/75 |
| 1,769,120 | 7/1930 | Dawson | 402/39 |
| 2,243,535 | 5/1941 | Newman | 402/37 |
| 2,568,131 | 9/1951 | Segal | 281/29 |
| 2,888,934 | 6/1959 | Segal | 402/37 |
| 3,132,649 | 5/1964 | Gits | 402/38 |
| 3,809,485 | 5/1974 | Beyer | 402/31 |
| 5,108,212 | 4/1992 | Lee | 402/75 |

FOREIGN PATENT DOCUMENTS

| | | | |
|---|---|---|---|
| 699977 | 2/1931 | France | 402/75 |
| 6413025 | 5/1965 | Netherlands | 402/75 |

*Primary Examiner*—Paul A. Bell
*Attorney, Agent, or Firm*—Hill, Steadman & Simpson

[57] ABSTRACT

A spring clip for mounting a ring metal to a ring binder wherein the spring clip is attached to a panel of the ring binder such as by a rivet, and the ring metal is snap engaged to the spring clips. The spring clips provide release levers for quickly and easily removing the ring metal from the ring binder for exchange or replacement. The ring metal can be provided with locator notches which register with locator tabs provided on the spring clip to locate the ring metal appropriately with respect to the ring binder and spring clips.

14 Claims, 1 Drawing Sheet

FIG. 1
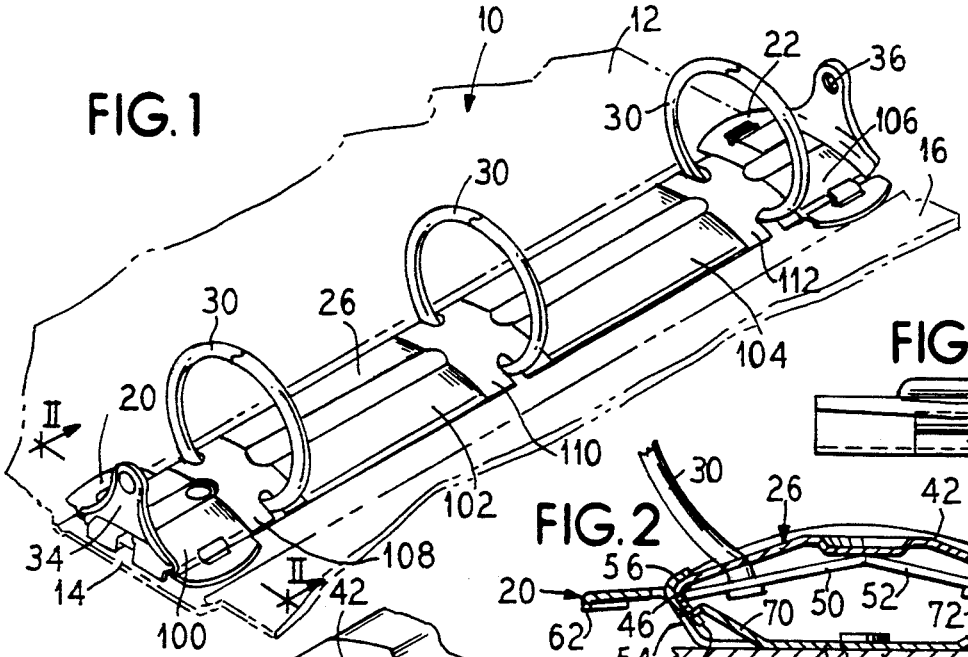
FIG. 3
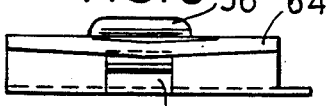
FIG. 2
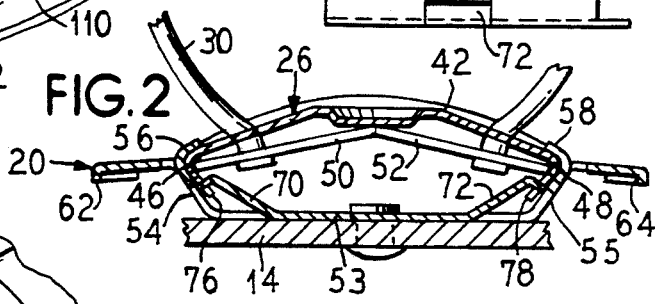
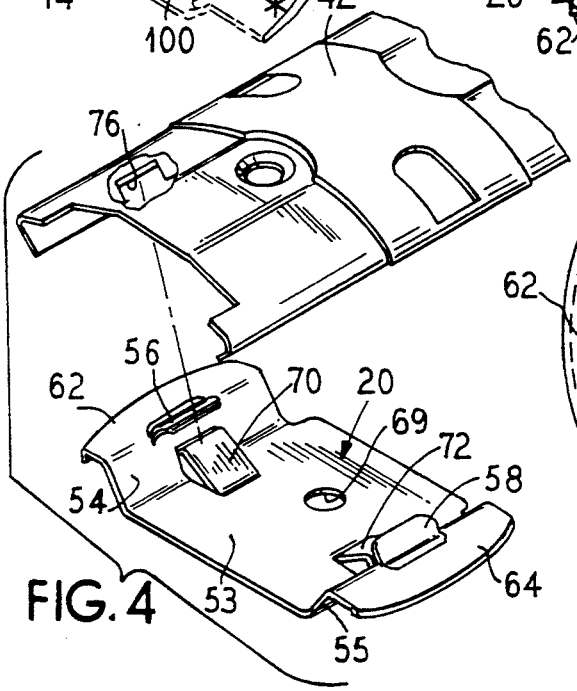
FIG. 4
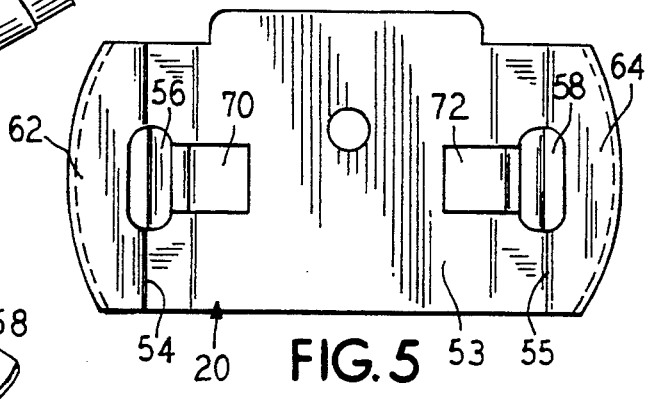
FIG. 5
FIG. 6
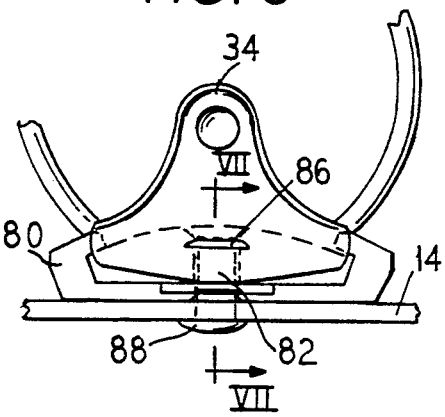
FIG. 7
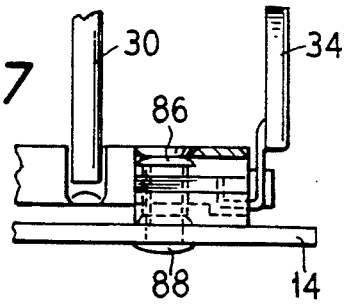

RELEASABLE ATTACHMENT FOR A RING METAL TO A RING BINDER

BACKGROUND OF THE INVENTION

The present invention is a releasable attachment for attaching a ring carrier or "ring metal" to a loose leaf binder cover or spine.

It is advantageous to provide an easily separable ring metal or ring carrier from the cover member to replace either the cover member or the ring metal. Thus, if a ring metal is in good and operable condition, but the cover member is warn or damaged or is otherwise in need of replacement, the ring metal can be separated from the cover member and installed onto a new cover member. Likewise, a cover member can be refitted with a new ring metal. This arrangement is particularly advantageous when one of the two components, ring metal and cover, is more expensive than the respective other, such as a decorative cover or a cover made of an expensive material.

Detachable ring metals are shown, for example, in U.S. Pat. No. 2,568,131, and U.S. Pat. No. 1,769,120. However, the easily detachable ring metal of the present invention is not disclosed.

SUMMARY OF THE INVENTION

It is an object of the present invention to provide an easily removable and replaceable ring metal for a ring binder cover. It is an object of the invention to provide that the ring metal is securely held on the cover along its length.

The objects are inventively achieved by providing at least one snap or spring clip mounted to a binder cover by a rivet or the like and extending upwardly from the binder in inwardly facing clip portions which are arranged to overlie a cover of the ring metal in the installed condition. Also, arranged outwardly facing from these clip portions are release levers which when downwardly or outwardly forced apart, spreads the clip portions to release the ring metal from the spring clip. Also provided on opposite sides of the spring clip are locating tabs which register with grooves formed on opposite lateral sides of the ring metal for proper positioning between the ring metal and spring clips on the cover member.

The above configurations provide for the easy locating of the ring metal with respect to the cover and the easy fastening and releasing of the ring metal to the cover.

BRIEF DESCRIPTION OF THE DRAWINGS

FIG. 1 is a partial perspective view of a ring binder utilizing the present invention;

FIG. 2 is a cross sectional view taken generally along line II—II of FIG. 1;

FIG. 3 is a right side elevational view of the spring clip of FIG. 2;

FIG. 4 is a partial exploded view of a ring metal and a spring clip of FIG. 1;

FIG. 5 is a plan view of the spring clip of FIG. 1;

FIG. 6 is an alternate embodiment of the spring clip shown in FIG. 1; and FIG. 7 is a sectional view taken generally along line VII—VII of FIG. 6.

DETAILED DESCRIPTION OF THE PRESENTLY PREFERRED EMBODIMENTS

FIG. 1 shows a ring binder generally at 10 comprising first cover member 12, a spine cover member 14 and a second cover member 16. Attached to the cover member is a first spring clip 20 and a second spring clip 22. Attached to the spring clips 22 is a ring metal 26 having a plurality of rings 30 attached thereto. Release levers 34, 36 are applied to the ring metal 26 at opposite ends thereof for opening and closing the rings 30.

FIGS. 2 and 3 show the spring clip arrangement in more detail.

FIG. 2 shows in cross section the spring clip 20 mounted to the spine cover member 14 of the cover member 10. The ring metal 26 comprises a flexible cover 42 having down turned hooked sides 46, 48 respectively. Resiliently engaged between the hook sides 46, 48 is a pair of hinged leaves 50, 52 whereupon the rings 30 are mounted. A more complete description of this configuration can be found in U.S. Pat. No. 5,116,157, issued May 26, 1992. The spring clip provides a base portion 53 extending upwardly in two side walls 54, 55 arranged on opposite lateral sides of the base portion 53. The spring clip 20 provides two clip portions 56, 58 respectively which overlie the cover 42 when installed. The clip portions 56, 58 extend inwardly from the side walls 54, 55 respectively. Release levers 2, 64 extend outwardly from the side walls 54, 55 respectively. Extending upward from the base portion 53 of the clip 20 are locator tabs 70, 72 respectively. The locator tabs 70, 72 register with slots 76, 78 of the cover 42. This is shown more clearly with respect to the slots 76 and the locator tab 70 FIG. 4. The slot 78 is not shown in FIG. 4, but is configured identically as the slot 76.

The spring clip 20 is preferably formed of steel plate where the clip portions 56, 58 and locator tabs 70, 72 can be formed by bending back metal portions of a flat plate which is also folded up at opposite ends to form the release levers 62, 64. Other suitable materials can also be selected and are encompassed by the invention.

A hole 69 is provided to rivet the spring clip 20 to the spine cover member 14.

To place the ring metal into the binder, first the spring clips 20 are riveted to the spine portion 14 through holes 69. Thereafter, the ring metal 26 is pressed downward with the notches 76, 78 registering with the locator tabs 70, 72 of the spring clips 20. The release lever 62, 64 are pushed downward to spread apart the clip portions 56, 58 and the ring metal is pressed downward until the clip portions 56, 58 clear a top surface of the cover 42. The release levers 62, 64 are then released and the clip portions 56, 58 spring inwardly to overlie the cover 42.

FIG. 6 shows an alternate embodiment wherein a spring Clip 80 is provided having a general C shape and having a rivet collar 82 extending upward at a central portion thereof. A rivet having terminal heads 86, 88 respectively holds the spring clip 80 to the spine cover member 14.

The alternate embodiment of FIGS. 6 and 7 can be composed of plastic or any other suitable material.

FIG. 1 and FIG. 4 show the flexible cover 42 comprising diversely shaped regions along its length. Regions 100, 102, 104 and 106 have a polygonal cross sectional shape made of straight wall segments, and regions 108, 110, and 112 have arcuate cross sections.

The regions 100, 102, 104, and 106 provide a lower overhead clearance than the regions 100, 102, 104 and 106 to form an upward limit stop for the leaves 50, 52. The polygonal cross section also increases rigidity of the flexible cover 42.

Although the present invention has been described with reference to a specific embodiment, those of skill in the art will recognize that changes may be made thereto without departing from the scope and spirit of the invention as set forth in the appended claims.

I claim as my invention:

1. A spring clip for holding a ring metal to a panel of a ring binder, The spring clip comprising:

opposite side wall portions arranged for connecting to and extending away from said panel;

clip portions extending inwardly from said side wall portions arranged and adapted to for overlying portions of said ring metal once installed; and lever means for spreading apart said clip portions said lever means comprising at least one release lever mounted to one of said side wall portions for releasing said metal ring from said spring clip.

2. The spring clip according to claim 1, wherein said lever means for spreading apart comprises a first release lever mounted to a first of said side wall portions and a second release lever mounted to a second of said side wall portions, said release levers extending outwardly from said ring metal, depression of said release levers deflecting said side wall portions outwardly to displace said clip portions away from said ring metal.

3. The spring clip according to claim 1, wherein said spring clip further comprises a base portion connecting said side wall portions and having a hole for riveting said spring clip to said ring binder.

4. The spring clip according to claim 1 further comprising locator means engageable with corresponding locator means on said ring metal for accurately axially locating said ring metal to said spring clip.

5. The spring clip according to claim 1, wherein said spring clip is formed of a flat metal plate and said clip portions comprise material partially cut from and bent off from said metal plate, and said means for spreading apart comprises a release lever bent outwardly from a first of said side wall portions and a second release lever bent outwardly from a second of said side wall portions.

6. The spring clip according to claim 1 further comprising two tabs, one tab located below each clip portion to clasp the ring metal therebetween when installed onto the spring clip.

7. A spring clip for holding a ring metal to a panel of a ring binder, the spring clip comprising:

opposite side wall portions for connecting to and extending away from said panel;

clip portions extending inwardly from said side wall portions arranged and adapted to overlie portions of said ring metal once installed; and means for spreading apart said clip portions mounted to one of said side wall portions for releasing said ring metal from said spring clip; and locator means engageable with corresponding locator means on said ring metal for accurately axially locating said ring metal to said spring clip;

wherein said locator means comprises tabs extending upwardly from said flat base, and said corresponding locator means in said ring metal comprises notches which register with said tabs.

8. The spring clip according to claim 6, wherein said spring clip is formed of a metal plate and said tabs comprise material partially cut from and deflected from said plate.

9. The spring clip according to claim 7, wherein said each of lip portions are arranged to clasp said ring metal against a respective tab.

10. A spring clip and ring metal arrangement for mounting a ring metal to a ring binder, said ring metal attachable to a panel of the ring binder, comprising:

a spring clip formed of a metal plate shaped into a general U-shape with out-turned lever portions, the side legs of said U-shape having clip portions extending inwardly therefrom to overlie said ring metal to hold said ring metal once installed to said spring clip; and means for locating said ring metal preselected axial alignment with said clip, said means disposed on said ring metal and said clip independent of said clip portions.

11. The spring clip and ring metal arrangement according to claim 10, wherein said means for locating comprises:

a locator tab extending upward from said base of said U-shape, and a notch formed in said ring metal at a selected location along said ring metal, said locator tab insertable into said notch.

12. The spring clip and ring metal arrangement according to claim 9 comprising a second identical spring clip, said second spring clip and said spring clip located at opposite ends of said ring metal.

13. A method for releasably installing a ring metal to a ring binder comprising the steps of:

providing a clip;

attaching said clip to said ring binder on a panel portion thereof;

providing that the clip have inwardly directed engaging portions for holding the ring metal;

providing release levers for disengaging said engaging portions from said ring metal by spreading said disengaging portions apart;

depressing said release levers to spread said engaging portions apart;

placing said ring metal into position over said clip;

pressing said ring metal against said clip;

releasing said release levers to allow said engaging portions to proceed inwardly to engage said ring metal.

14. The method according to claim 12 comprising the further steps of:

providing locator formations on said clip;

providing corresponding locator formations on said ring metal;

when placing said ring metal above said clip arranging said corresponding locator formations aligned with said locator formations of said clip; and when pressing said ring metal against said clip, engaging said locator formations to said corresponding locator formations.

* * * * *